United States Patent [19]

Rosen et al.

[11] 4,343,095

[45] Aug. 10, 1982

[54] PRESSURE DRYER FOR STEAM SEASONING LUMBER

[75] Inventors: Howard N. Rosen; Robert E. Bodkin, both of Carbondale; Kenneth D. Gaddis, Johnston City, all of Ill.

[73] Assignee: The United States of America as represented by the Secretary of Agriculture, Washington, D.C.

[21] Appl. No.: 246,971

[22] Filed: Mar. 24, 1981

[51] Int. Cl.[3] ..... F26B 5/04; F26B 13/30

[52] U.S. Cl. ..... 34/16.5; 34/92

[58] Field of Search ..... 34/9.5, 13.4, 13.8, 34/16.5, 92

[56] References Cited

U.S. PATENT DOCUMENTS

| | | | |
|---|---|---|---|
| 3,434,222 | 3/1969 | Malmquist | 34/16.5 |
| 3,744,144 | 7/1973 | Weis | 34/16.5 |
| 3,971,139 | 7/1976 | Rochon | 34/13.8 |
| 4,058,906 | 11/1977 | Pagnozzi | 34/16.5 |
| 4,176,466 | 12/1979 | Pagnozzi et al. | 34/230 |
| 4,194,296 | 3/1980 | Pagnozzi et al. | 34/16.5 |
| 4,198,763 | 4/1980 | Kurihara | 34/16.5 |

*Primary Examiner*—John J. Camby

*Attorney, Agent, or Firm*—M. Howard Silverstein; David G. McConnell

[57] ABSTRACT

A process and apparatus for accelerated drying of green and partially dried lumber at pressures above atmospheric pressure to rapidly remove selected portions of moisture from the wood without degradation of the wood structure. A kiln for performing the method comprises a generally cylindrical kiln chamber to contain a stack of lumber, a by-pass line from the front to the back of the chamber to heat and distribute steam evenly to the lumber surfaces, a pressure-controlled steam vent to regulate kiln temperature, and temperature control to regulate the rate of drying. Conditions of pressure and temperature in the kiln can be regulated by heat added from an external source to equalize and condition the lumber rapidly in steam.

10 Claims, 3 Drawing Figures

PRESSURE DRYER FOR STEAM SEASONING LUMBER

DISCLOSURE OF THE INVENTION

This invention relates to the drying and seasoning of lumber.

Most lumber is dried by conventional kiln whereby the moisture content of the boards is carefully reduced to a desired level by use of heat to vaporize a portion of the moisture in the lumber to produce the seasoned lumber. Kiln dried lumber has traditionally been dried at atmospheric pressure at temperatures below 200° F. with relative humidity in the kiln carefully controlled to avoid degradation of the wood. Conventional kiln drying has two major drawbacks: first, it is slow, taking from one week to several months depending on wood species and board thickness; and second, it is energy inefficient, requiring two to four times the minimum energy necessary to evaporate the water.

High-temperature kiln drying, whereby lumber is dried at temperatures from 200° to 350° F. at atmospheric pressure has recently been used to reduce drying time to less than one day. In such processes, as the lumber dries, the moisture content at the surface of the boards drops quickly to the equilibrium moisture content, EMC (that moisture content at which wood neither gains nor loses moisture at a given humidity and temperature), while the interior remains wet. Such processes create steep moisture gradients between the surface of the boards and the interior that persist as the wood dries and can cause the wood to degrade or to stress internally (caseharden).

For example in conventional kiln drying conditions are initially set in the kiln so that EMC is between 15 and 20 percent. In high temperature drying at temperatures above 220° F. dry bulb temperature and 190° F. wet bulb temperature, the EMC is at most 4%.

Prior art methods of high temperature drying are shown in U.S. Pat. No. 3,521,373—Pagnozzi and U.S. Pat. No. 3,971,139—Rochon.

Normal procedure after drying many wood species, depending upon the final use of the wood, is to have an equalizing period, whereupon the variation in moisture content between the surface and interior is reduced, followed by a conditioning period, whereupon moisture is added to the surface of the wood to relieve internal stresses. These equalizing and conditioning steps are normally done at temperatures below 180° F. and can take several days to complete.

Other methods previously utilized in drying lumber include chamber drying, whereby lumber is dried in an air tight structure, usually done at subatmospheric pressures. One example of the prior art being shown in U.S. Pat. No. 4,176,466—Pagnozzi where heat and subatmospheric pressure are used. The advantage of this process is the faster removal of moisture from wood at lower temperatures, thus reducing drying time compared to conventional kiln drying. Energy is also conserved because of negligible heat loss from leakage and no energy required to heat vented air as in a conventional or high-temperature kiln. However, vacuum drying is slow compared to a high-temperature drying and difficulties in maintaining high enough circulation rates for adequate removal of the water from the surface of the wood remain a major problem.

Prior art methods and apparatus for drying lumber utilizing steam are shown in U.S. Pat. No. 4,058,906—Pagnozzi; U.S. Pat. No. 4,127,946—Bucholz where a mixture of steam and air are utilized.

Other prior art methods are shown in U.S. Pat. No. 3,971,139—Rochon; U.S. Pat. No. 4,198,763—Kurihara; U.S. Pat. No. 4,176,466—Pagnozzi and U.S. Pat. No. 4,017,980—Kleingnether.

The present invention recognizes that steam has a greater ability to transfer heat and requires less blower horsepower to deliver a given amount of air; thus, pure steam is a more efficient gas than air-steam mixtures to dry wood.

Attempts to dry large quantities of lumber at elevated temperatures and pressures have so far been unsuccessful. Steep moisture and temperature gradients throughout the entire load of lumber due to poor heat distribution have caused severe defects in the dried lumber.

Most lumber dryers circulate an air-water vapor or air-steam mixture to carry away the evaporated water from the surface of the wood.

No prior art method is known where air is first evacuated from the kiln and steam generated from moisture in the lumber utilized to accomplish the drying by circulating and heating the steam.

SUMMARY OF THE INVENTION

The present invention provides a more efficient and effective lumber dryer by rapid and even circulation of steam throughout the load of lumber to insure even heat distribution and allow drying of lumber in steam at pressures above the atmospheric pressure and temperatures above 212° F.

Moreover, devices within the scope of the present invention provide a means of steam removal from the dryer which also controls the temperature in the dryer at higher pressures and to mechanically remove a portion of the water from wood and remove that water from the dryer without evaporating the water.

The benefit and advantages of the present invention are achieved by a process and apparatus in which air is removed from a kiln adapted to receive green or partially dried lumber and heat the kiln above atmospheric pressure in the presence of circulating steam, which facilitates the rapid removal of moisture from the lumber without excessive degration to the wood structure. The drying rate is kept substantially uniform through the load of lumber by evenly distributing a high flow rate of steam over the surface of the boards by the use of spacers between the boards and strategically placed baffling in the kiln. Also the temperature in the dryer is controlled in connection with the pressure in the drying chamber, and not solely with the heat input as in those processes of prior art where the heat input to the dryer controls the drying temperature.

More specifically, the process of the present invention consists of the steps of placing the green or partially dried wood in an enclosed chamber which thereafter is evacuated to remove the air. Heat is applied to the chamber until the pressure resulting from evaporation of moisture from the lumber reaches the desired value depending on the drying schedule for the type of lumber being dried, (normally between 15 and 50 psi), so that operating temperatures run between 215° and 350° F. Steam circulation rate is regulated so that flows are from 50 to 500 feet per minute, generally higher during the initial stages of drying and lower during equalizing and conditioning. Water which accumulates on the bottom if the drying chamber from condensation of steam or from free water being forced out of the ends of the boards by internal pressure in the wood, is periodically ejected from the dryer.

Additional features and advantages of the invention will become apparent from the following description, with reference to the accompanying drawings, which are not presented by way of limitation.

DETAILED DESCRIPTION OF INVENTION

Figure 1:
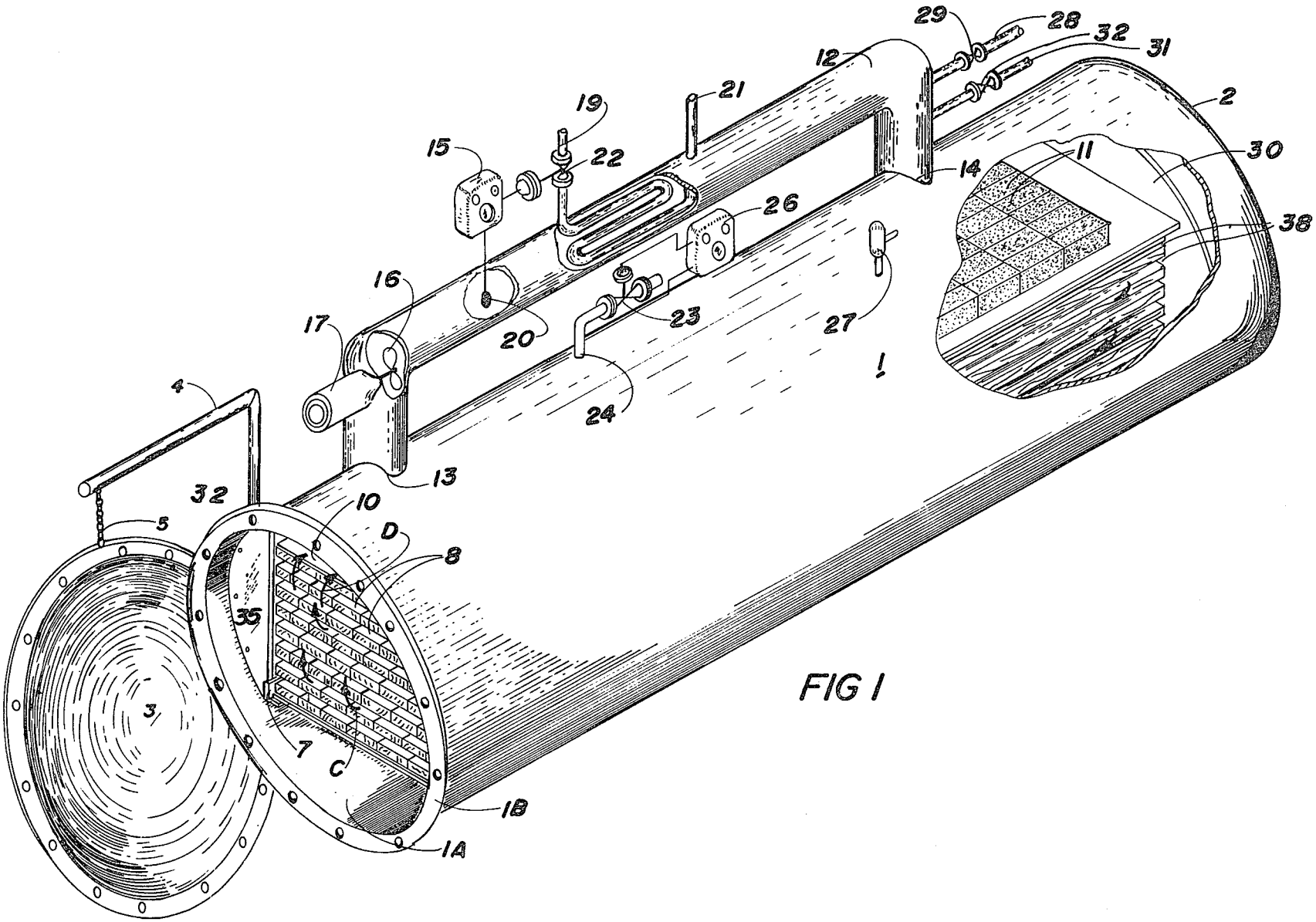
FIG. 1 is a perspective view of an example of a drying apparatus showing the drying chamber, and circulation system.
Figure 2:
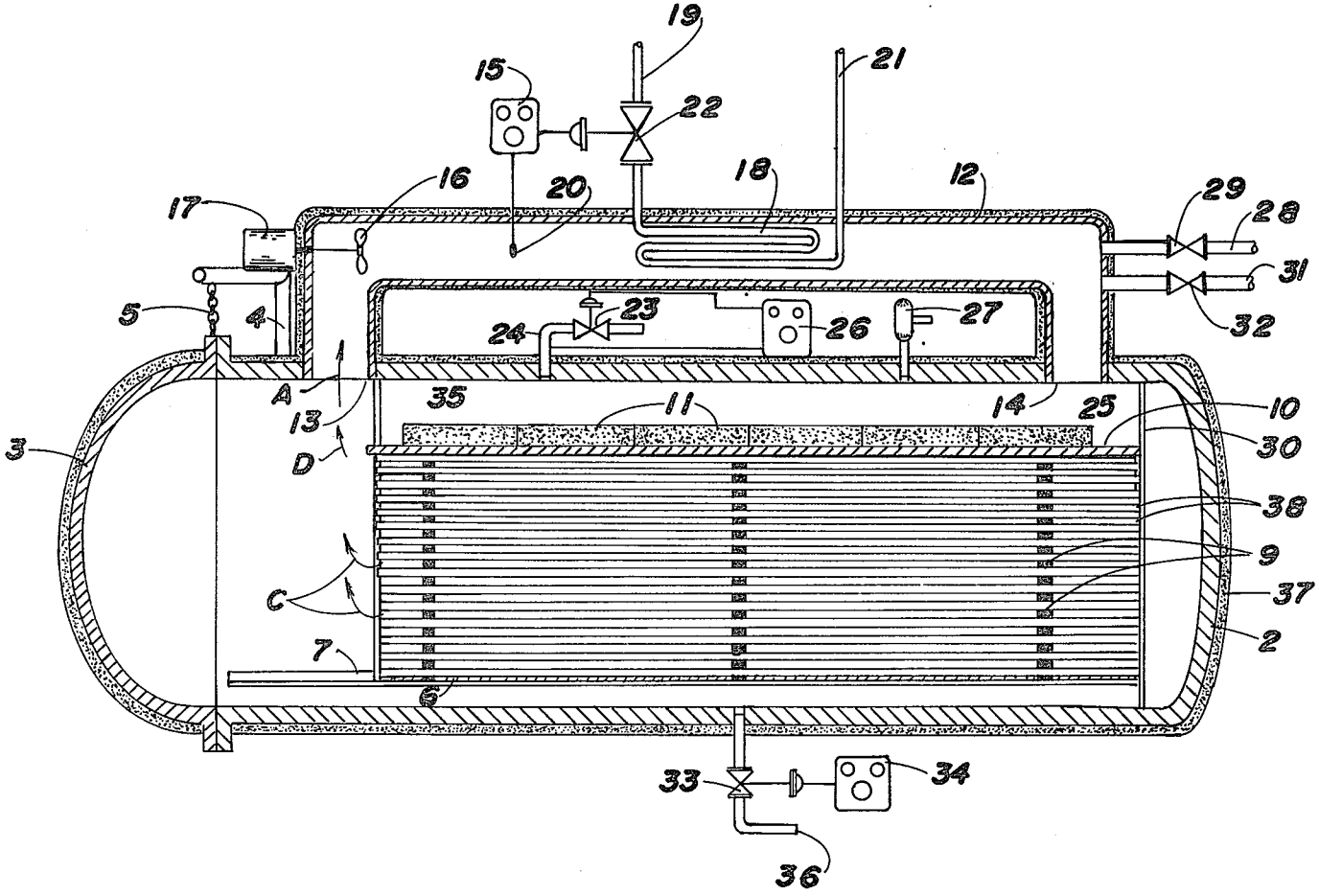
FIG. 2 is a longitudinal section through a drying apparatus for carrying out the process according to the invention.

Referring to FIGS. 1 and 2 a horizontal cylindrical pressure vessel 1 is shown which is closed at one end by a wall 2 and is adapted at the opposite end 1A to received a flanged cover member 3 secured to flange 1B of vessel 1. Cover member 3 can be carried by a pivotable boom 4 by means of a chain 5 to facilitate removal and replacement of cover 3.

A carriage 6 is provided within vessel 1 and adapted to side on cooperative rails 7 selectively located longitudinally inside vessel 1 as shown.

Wooden boards 8 are stacked on carriage 6 so that the length of the boards are parallel to the longitudinal axis of vessel 1 and spacers 9 are provided to separate different levels of the boards so that the entire surface of each board is exposed. Cover 10, for example, a metal sheet, can be placed on top of the lumber stack and weights 11, for example, of concrete or other nonmetal dense material, can be placed to restrain the lumber from excessive warpage during drying. A back baffle 30 is provided adjacent end 1A between the outer wall and the end of of the lumber stack as shown to direct steam flow as described hereinafter.

Within the scope of the present invention a steam circulation bypass 12 can be provided and in the example shown, bypass 12 has an inlet 13 at the open end of vessel 1 and an outlet 14 adjacent the closed end of vessel 1. A blower 16 which can be driven by a variable speed electric motor 17 is provided to circulate steam through bypass 12. Within the scope of the present invention a heater can be provided to heat the steam flowing through bypass 12.

In the example shown a heater 18, which is a coil supplied with steam or some other heat transfer fluid through a source 18 and return 21 is provided. A control valve 22 is provided to control flow of heat transfer fluid to coil 18 in response to regulator 15 which includes a sensor 20 to sense the temperature of vapor from vessel 1 admitted to bypass 12 so that vapor in bypass 12 is heated and the drying occurs at a predetermined rate. Steam flow to coil 18 is controlled by regulator 15 in response to temperatures in bypass 12 measured by sensor 20.

Within the scope of the present invention the pressure in vessel 1 can be controlled, and in the example shown is controlled by venting steam through a control valve 23 of a vent line 24 in response to a selected pressure measured by a sensing regulator 26 which controls valve 23. A pressure relief valve 27 is located on a vessel 1 in the event the pressure goes over a predetermined limit.

If desired, steam can be added to vessel 1 from a steam line 28 through a valve 29 and vacuum can be drawn on vessel 1 through vacuum line 31 and valve 32.

Also within the scope of the present invention water can be periodically removed from vessel and in the example shown in removed through drain 26 (FIG. 2) from the bottom of the vessel 1 where a control valve 33 can be provided and regulated by, for example a timer 34.

To further reduce energy consumption (as shown in FIG. 2) vessel 1 can be insulated and in the example shown vessel 1, front and back ends 2 and 3 and the bypass 12 are lined with a layer of thermal insulating material 37 so that heat loss from the dryer surface is minimal.

FIG. 2 also illustrates how the steam is evenly circulated over the boards in the dryer so that no "short circuiting" occurs. Briefly as shown by arrow A, steam is withdrawn, through inlet 13 from the front of vessel 1 by blower 6 and is emitted through outlet 14 at the rear of vessel 1 to a cavity 25 defined between the back baffle 30, for example a metal sheet extending across the diameter of vessel 1 at the rear end so that the ends of boards 8 are flush against it, and front baffle 35, located as shown in FIG. 1; so the steam is directed across the lumber through openings 38 formed by the spaces 9 between boards 8. The steam then flows to the front of vessel 1 as shown by arrows C and then back to the intake 13 as shown by arrows D.

Figure 3:
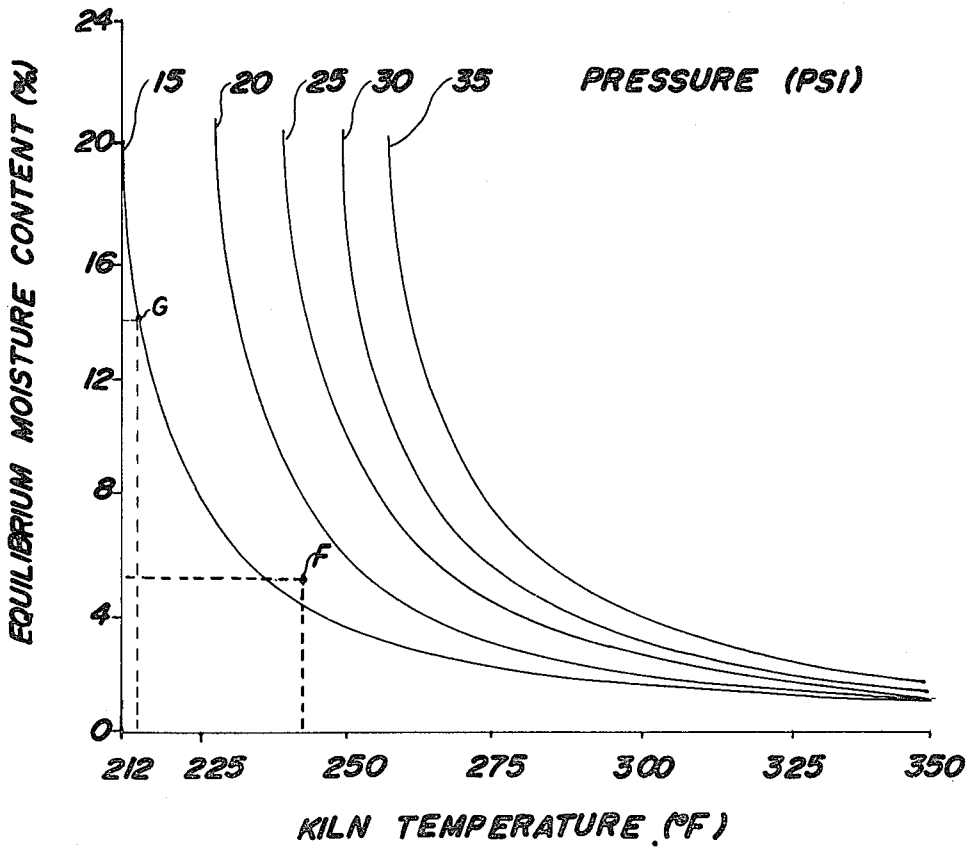
FIG.3 shows an equilibrium moisture content temperature diagram for steam at various pressures in the drying chamber.

FIG. 3 is a graphic representation of equalization and conditioning of lumber at temperatures above 212° F. in the apparatus of this invention. In one method in accordance with the present invention the moisture content of the lumber is equalized, after drying, by subjecting the material to conditions such that the EMC is 1 to 3 percent below the final desired moisture content of the wood. The time for equalization depends on thickness and wood species. Following equalization, the lumber is conditioned under conditions where the temperature and pressure in the dryer correspond to an EMC of 5 to 15 percent above the final moisture content to which the lumber is to be dried.

For example, if lumber is to be dried to 6 percent moisture content, as shown in FIG. 3, then following the drying period, conditions in the dryer will be changed to 240° F. and 16 psi as shown by point F (5% EMC) for several hours to equalize and then as shown by point G the conditions are changed to 215° F. and 15 psi (14 percent EMC) for several hours to condition the lumber.

In operation the dryer, vessel 1 is loaded with lumber 8 with spaces 9 between levels of the lumber. Front baffle 35 is secured in place against the edge of the stack, for example, by means of bolts, not shown. Front cover 3 is closed. A vacuum of 25 inches of mercury is drawn on vessel 1 through vacuum line 31. Blower 16 is started to circulate water vapor released from the lumber by the decreased pressure and the pressure regulator 26, heat regulator 15 and timer 34 for the water bleed valve 33 are set to predetermined set points and activated. The temperature in vessel 1 increases as steam is produced from the water evaporated from the wood and is heated in bypass 12 until the pressure reaches the set limit at which point steam is released from the vent line. Water is removed periodically from the water bleed line during operation.

After the drying cycle, the conditions of temperature and pressure are changed to equalize the wood moisture content where steam is added from an external source, if and when needed, through a steam line 28. Following the equalizing cycle, the conditions of temperature and pressure are adjusted to condition the wood to relieve internal stresses where steam can be added to the dryer through the steam line 28 as needed and described hereinafter.

EXAMPLES

The following examples are given to facilitate a more detailed and better understanding of the present invention, and are not intended to limit this invention to these examples.

EXAMPLE I

One hundred board feet of yellow-poplar (1 inch by 4 to 6 inches by 100 inches), 90 to 118 percent initial moisture content, were placed in stacks in a dryer similar to the one in FIG. 1. The boards were dried under the following conditions:

Drying:
- Temperature—230° to 265° F.
- Pressure—19 psi
- Drying Time—30 hours

The water was automatically drained from the tank every two hours for 90 seconds. The final moisture content of the lumber was 5 to 6 percent and the quality of the lumber was comparable to conventionally kiln-dried lumber. Internal stress evaluation by standard procedures known to those knowledgeable in the art showed moderate stress remaining in the wood.

EXAMPLE 2

On hundred board feet of air-dried red oak (1 inch by 4 to 6 inches by 100 inches), 17 to 19 percent initial moisture content, were placed in stacks in a dryer similar to the one in FIG. 1. The boards were seasoned under the following conditions:

Drying:
- Temperature—240° to 260° F.
- Pressure—19 psi
- Drying time—18 hours

Equalizing:
- Temperature—240° F.
- Pressure—16 psi
- Equalizing Time—2 hours

Conditioning:
- Temperature—215° F.
- Pressure—15 psi
- Conditioning Time—4 hours The water was automatically drained from the tank every two hours for 90 seconds during the drying cycle only. Steam was added to the system in the equalizing and conditioning cycles. The final moisture content was 6 to 7 percent and reached in 24 hours total seasoning time. The quality of the lumber was comparable to conventionally dried lumber and standard procedures for internal stresses showed stresses were relieved.

While a particular dryer has been illustrated in the invention, variation may readily be made without departing from the spirit of the invention. Variations and modifications will become apparent to those skilled in the art, and it is desired to cover all such variations and modifications which are within the scope of the invention.

CLAIMS OF THE INVENTION

Described in this invention is a steam pressure dryer and process for drying wood not described in other dryers.

We claim:

1. A lumber dryer including an air tight vessel defining a kiln chamber to receive a multiplicity of wooden boards to be dried which includes:

a. carrier means to dispose said boards in said vessel in generally parallel spaced relation.

b. a steam bypass line housing an inlet communicating with said vessel and an outlet communicating with said vessel.

c. blower means to move gas from said bypass line to heat gas passing therethrough;

d. heater means within said bypass line to heat gas passing therethrough;

e. baffling means disposed within said vessel to direct gas across the surface of said lumber.

f. evacuation means to selectively remove air from said vessel;

g. pressure control means to selectively emit steam from said vessel.

h. temperature control means to regulate the supply of heating means to said heater means.

i. Automatic water drainage control means to selectively emit water from said vessel.

2. The invention of claim 1 wherein said water drainage control means periodically at regular time intervals emits water from said vessel.

3. The invention of claim 1 wherein said heater means includes steam receiving coil means located within said steam bypass line.

4. The invention of claim 3 wherein said steam bypass line is external to said vessel.

5. A process for accelerated drying of lumber at pressures above atmospheric pressure to rapidly remove moisture from the wood in a generally cylindrical kiln defining a chamber to contain boards having a bypass line with an inlet and outlet communicating with the chamber, heater means to heat gas within the bypass line and blower means to move gas through the bypass line including;

a. loading the boards in the kiln in generally parallel spaced relation;

b. evacuating air from the chamber to a selected absolute pressure within the chamber whereby water vapor is emitted from the wood; and c. circulating the water vapor, as steam through said bypass line and heating said steam to a selected temperature above 212° F. to provide a selected steam pressure in said chamber to heat said lumber and vaporize water therefrom to provide dried lumber of selected moisture content.

6. The invention of claim 5 wherein said steam pressure in said chamber is maintained at selected value by selectively venting steam from said chamber.

7. The invention of claim 5 including periodically exhausting liquid from the bottom of said vessel.

8. The invention of claim 5 wherein the temperature in said chamber is controlled by venting steam from said chamber.

9. The invention of claim 5 including drying said lumber to a moisture content less than the final desired moisture content, equalizing moisture throughout said boards by adjusting the steam pressure and temperature within said chamber to provide saturated steam in said chamber and exposing the lumber to said steam until the moisture content of the lumber is 1 to 3% below the equilibrium moisture content at selected atmospheric conditions.

10. The invention of claim 8 wherein said lumber is exposed to supersaturated steam so the moisture content of the lumber is increased to a selected concentration above the equalibrium concentration at select atmospheric conditions.

* * * * *